US005839831A

United States Patent [19]

Mazzocchi

[11] Patent Number: 5,839,831

[45] Date of Patent: Nov. 24, 1998

[54] FLEXIBLE PACKAGE HAVING IMPROVED GRIPPER RIDGES AND METHODS THEREOF

[75] Inventor: Randolph A. Mazzocchi, Greenville, Wis.

[73] Assignee: Reynolds Consumer Products, Inc., Appleton, Wis.

[21] Appl. No.: 795,675

[22] Filed: Feb. 6, 1997

[51] Int. Cl.[6] ..... B65D 33/16

[52] U.S. Cl. ..... 383/65; 383/35; 383/63; 24/587

[58] Field of Search ..... 383/35, 63, 65; 24/587, 576

[56] References Cited

U.S. PATENT DOCUMENTS

| | | | |
|---|---|---|---|
| 4,363,345 | 12/1982 | Scheibner . | |
| 5,009,828 | 4/1991 | McCree . | |
| 5,167,454 | 12/1992 | Woods et al. | 383/35 |
| 5,209,574 | 5/1993 | Tilman . | |
| 5,366,294 | 11/1994 | Wirth et al. | 383/65 X |
| 5,369,847 | 12/1994 | Naya et al. . | |

FOREIGN PATENT DOCUMENTS

| | | | |
|---|---|---|---|
| 0276554 | 8/1988 | European Pat. Off. | 383/63 |

*Primary Examiner*—Jes F. Pascua
*Attorney, Agent, or Firm*—Alan M. Biddison

[57] ABSTRACT

A gripper ridge for use on a flexible package includes first and second walls normal to the flexible package with first and second extended ends and an end surface between the first and second extended ends. The end surface and first extended end are arranged to provide enhanced gripping friction perceptible to touch. The length of the first wall is greater than the length of the second wall, such that the end surface is angled. In one implementation, the end surface and first extended end form a rounded surface therebetween. One embodiment includes a flexible package with one or more gripper ridges attached to the interior of the flexible package. In other embodiments, one or more gripper ridges are attached to the exterior of the flexible package. A die for making a gripper ridge and methods for making a gripper ridge are also described.

12 Claims, 4 Drawing Sheets

FLEXIBLE PACKAGE HAVING IMPROVED GRIPPER RIDGES AND METHODS THEREOF

FIELD OF THE INVENTION

The present invention relates generally to flexible package arrangements. More specifically, the present invention relates to gripper ridges for reclosable arrangements for flexible bags.

BACKGROUND OF THE INVENTION

Flexible packages sometimes use reclosable closure arrangements. One type of reclosable closure arrangement includes a zipper-type closure. Other types of reclosable-type closure arrangements are also sometimes used.

One typical reclosable zipper includes male and female closures extending along the length of the zipper. The closures are interlocked by properly aligning the male and female closures and pressing the closures together along the entire length of the zipper. To open the closure arrangement, the user grasps the bag panel sections in order to pull the interlocking profiles apart.

The closures are often attached to bags made from a polymeric material. Polymeric bags are prone to become slippery if wet or greasy. If the bags are wet or greasy, or if the user of the bag has wet or greasy hands, manipulation of the bag by the user may be difficult. In particular, it is sometimes difficult to grip or hold onto the bag in order to perform the opening and closing operation of the closure arrangement.

Another problem sometimes encountered is that the bag walls between the closure arrangement and the top of the bag opening cling together when moist. This sometimes presents further difficulty in operating the closure arrangement.

Therefore, a need exists for improving the ease of performing the opening operations of a reclosable-type closure arrangement.

SUMMARY OF THE INVENTION

One aspect of the present invention is directed to a gripper ridge for use on a bag. The gripper ridge comprises a first wall normal to the bag and includes a first extended end. The first wall has a first length extending between the bag and first extended end. A second wall is normal to the bag and includes a second extended end. The second wall has a second length extending between the bag and the second extended end. An end surface extends between the first extended end and the second extended end. The end surface and first extended end are arranged to provide enhanced gripping friction perceptible to touch.

In the preferred arrangements, the first length is greater than the second length.

In certain implementations, the end surface and first extended end form a rounded surface therebetween, skewed toward the inside of the bag.

In another aspect, the invention is directed to a reclosable bag. The reclosable bag comprises an outer enclosure including a surrounding wall portion, a product-supporting bottom, and a reclosable mouth opposing the product-supporting bottom. The wall portion includes an interior surface oriented toward an interior of the bag and an opposite exterior surface. A closure arrangement is integral with or secured to the wall portion and adjacent to the mouth to allow an opening and closing of the mouth. A first gripper ridge is integral with or secured to the interior surface of the wall portion. The first gripper ridge is constructed and arranged to include a first gripping end perceptible to touch as oriented toward the closure arrangement.

In one implementation, the first gripper ridge includes first and second opposite walls each being oriented substantially normal to the bag wall portion. The first wall includes a first extended end, and the second wall includes a second extended end. The first gripper ridge includes an end surface between the first and second extended ends. The end surface and first extended end are arranged to form the first gripping end.

In the preferred embodiment, the first wall is closer to the closure arrangement than the second wall. The first wall includes a first length from the wall portion to the first extended end, and the second wall includes a second length from the wall portion to the second extended end. The first length is greater than the second length.

In one embodiment, the closure arrangement includes a zipper-type closure.

Certain embodiments include the surrounding wall having first and second opposed panel sections joined along a pair of sealed edges. Each of the first and second panel sections include an interior surface and an exterior surface. The first gripper ridge is secured to the interior surface of the first panel section and is located between the mouth and the closure arrangement. A second gripper ridge is secured to the interior surface of the second panel section. In other embodiments, the second gripper ridge is secured to the exterior surface of the second panel section. In yet other embodiments, the second gripper ridge is secured to the exterior surface of the first panel section. The second gripper ridge includes a second gripping end perceptible to touch as oriented toward the zipper closure arrangement.

In other implementations, the bag further includes a third gripper ridge. The third gripper ridge is secured to the interior surface of the first panel section and adjacent to the first gripper ridge. In other arrangements, the third gripper ridge is secured to the exterior surface of the first panel section. In still other arrangements, the third gripper ridge is secured to the exterior surface of the second panel section.

In another embodiment, the bag further includes a fourth gripper ridge secured to the interior surface of the second panel section. The fourth gripper ridge is secured to the exterior surface of the second panel section.

In certain implementations, the gripper ridges and closure arrangements are included in first and second strips which are secured to the first and second walls of the bag in the bag making process. The gripper ridge or ridges are located near the top of the bag between the bag mouth and the closure arrangement.

In another arrangement, the bag further includes a second strip. The second strip is arranged to secure a second gripper ridge to the second panel section. A third gripper ridge is secured to the first strip, and a fourth gripper ridge is secured to the second strip.

In another aspect of the invention, a die includes an inlet and an outlet used in making a gripper-ridge profile. The outlet has a profile including a base, a first edge, a second edge, and a third edge extending between the first and second edges. The first edge extends normal to the base and has a first length; and the second edge extends normal to the base and has a second length less than the first length.

In one arrangement, the first length is from about 1.5 to 2.5 times a thickness of the base. The second length is from about 1.0 to 2.0 times a thickness of the base. The third edge is from about 1.0 to 1.5 times a thickness of the base.

In one implementation, a fourth edge is opposite to the third edge. The fourth edge includes a peak to reduce an amount of material in a final extrusion.

In another aspect of the present invention, a method for making a gripper ridge comprises providing a die having an inlet and an outlet. The outlet includes a profile including a base, a first edge, a second edge, and a third edge extending between the first and second edges. The first edge extends normal to the base and has a first length; and the second edge extends normal to the base and has a second length less than the first length. A molten thermoplastic material is pumped through the inlet. A gripper ridge is extruded through the outlet profile.

In one embodiment, the providing step includes providing the outlet profile with a fourth edge opposite to the third edge, the fourth edge including a raised peak. The extruding step includes extruding a gripper ridge including a reduced amount of molten material in a region of the fourth edge.

The above summary of the present invention is not intended to describe each disclosed embodiment of the present invention. This is the purpose of the figures and the detailed description which follow.

BRIEF DESCRIPTION OF THE DRAWINGS

Other aspects and advantages of the invention will become apparent upon reading the following detailed description and upon reference to the drawings in which.

Figure 1:
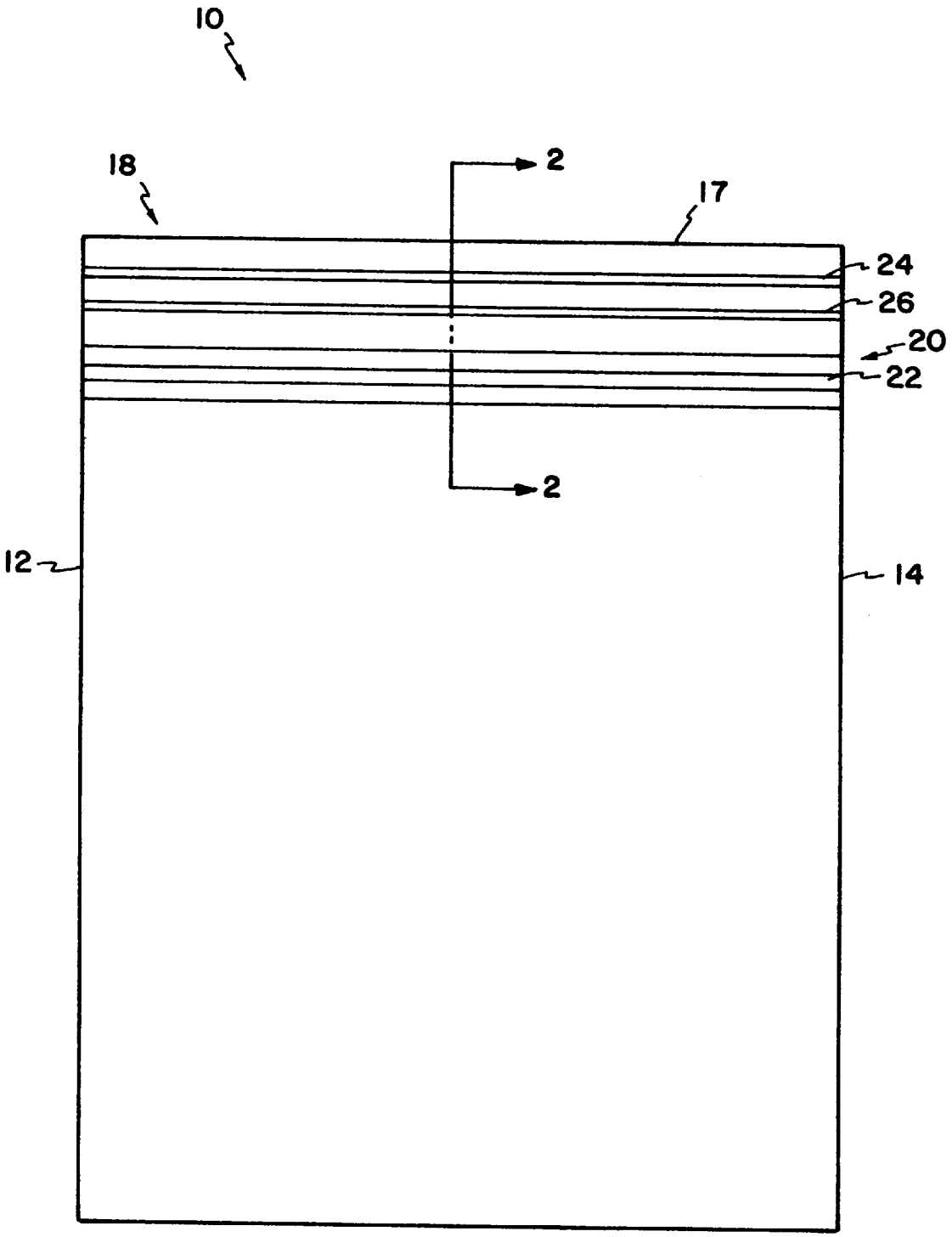
FIG. 1 is a front elevational view of one embodiment of a flexible packaging arrangement, made in accordance with an embodiment of the claimed invention.

While the invention is susceptible to various modifications and alternative forms, specifics thereof have been shown by way of example in the drawings and will be described in detail. It should be understood, however, that the intention is not to limit the invention to the particular embodiment described. On the contrary, the intention is to cover all modifications, equivalents, and alternatives falling within the spirit and scope of the invention as defined by the appended claims.

DESCRIPTION 0F THE VARIOUS EMBODIMENTS

Flexible package arrangements come in a variety of shapes and sizes and serve various purposes. One type of flexible package arrangement includes a bag having a reclosable-type closure. There are instances when it is useful to have structure to help the user grasp the bag in order to open the reclosable-type closure. Gripper ridges positioned adjacent to and between the closure arrangement and the bag opening are used to provide the user with enhanced structure and material to improve his or her grasp on the bag and help open the closure arrangement. As described in detail below, one aspect of the present invention relates to improving the gripping friction of a gripper ridge, while also reducing the amount of material necessary in order to make a gripper ridge.

One type of flexible package arrangement, a bag, is illustrated in FIG. 1 generally at 10. In one embodiment, bag 10 is made from a film of polymeric material, and is sealed together at first side seal 12, and second seal 14. Bag 10 includes a bottom 16 and a top 17, at an opposite end thereof. A mouth 18 is opposite to bottom 16 and adjacent to top 17, and provides access to the bag interior. Mouth 18 is configured to be openable and closable through a closure arrangement, shown generally at 20. Closure arrangement 20, in this particular embodiment, includes a zipper 22. The closure arrangement in other embodiments includes other types of closure arrangements. Positioned between zipper 22 and top of bag 17 are first and second gripper ridges 24, 26.

Figure 2:
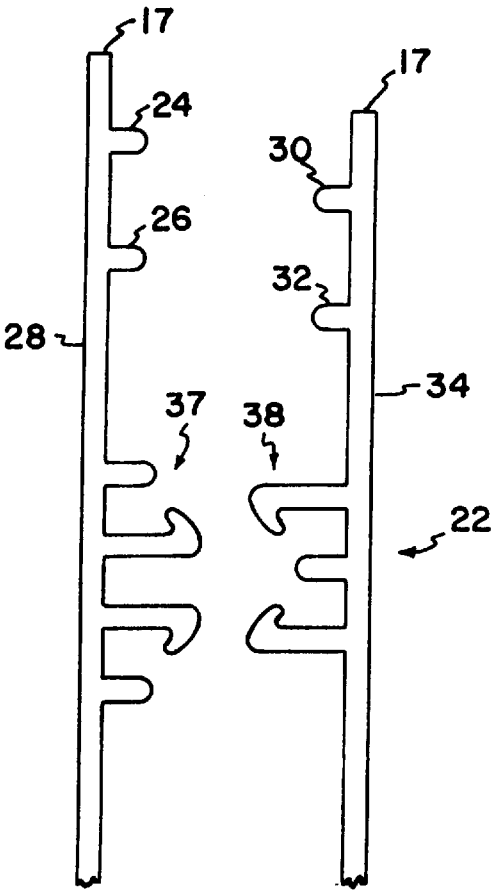
FIG. 2 is a cross-sectional view of the closure arrangement taken along the lines II—II of FIG. 1, made in accordance with an embodiment of the claimed invention.

As illustrated in FIG. 2, each of the gripper ridges is located between the top of the bag 17 and the zipper 22. In this embodiment, first and second gripper ridges 24, 26 are located on an interior surface of a first wall 28 of the bag, and third and fourth gripper ridges 30, 32 are located on a second wall 34 of the bag. The zipper 22, in the embodiment illustrated in FIG. 2, has a male profile 37 on first bag wall 28, and a female profile 38 on second wall 34 of the bag. First, second, third, and fourth gripper ridges.24, 26, 30, 32 extend the length from first side seal 12 to second side seal 14 of bag 10. The gripper ridges provide the user with structure to grasp to aid in opening and closing of the zipper 22. While two gripper ridges per bag wall are illustrated, other embodiments include more or fewer gripper ridges. Further, other implementations include gripper ridges positioned on the exterior surface of the bag walls.

Figure 3:
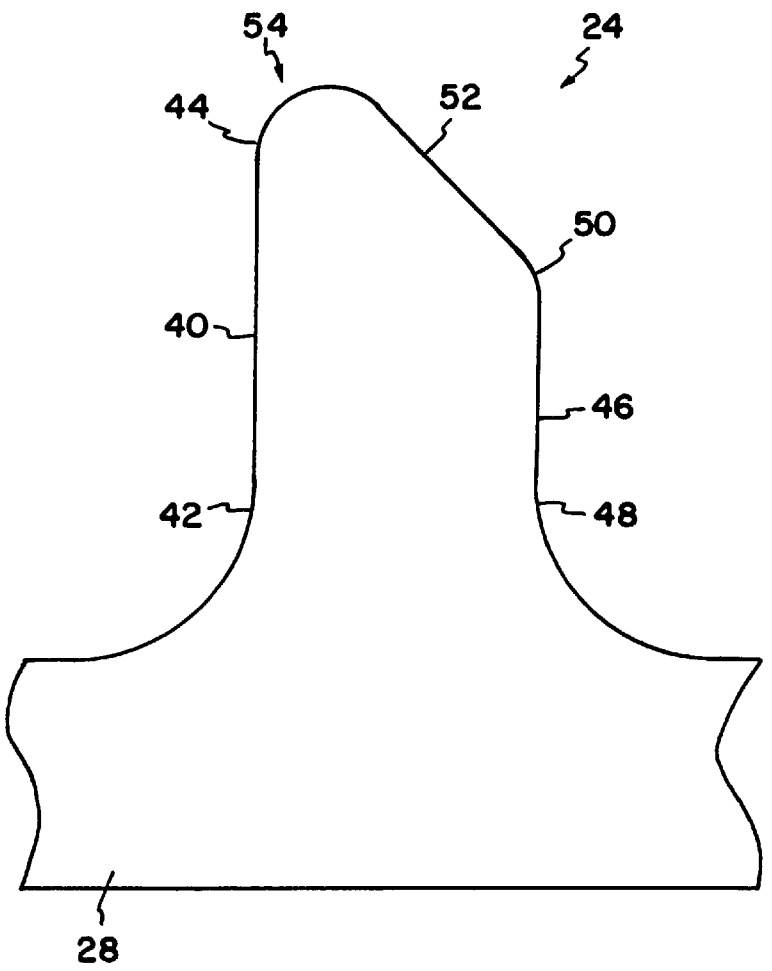
FIG. 3 is a cross-sectional view of one embodiment of a gripper ridge, constructed in accordance with an embodiment of the claimed invention.

FIG. 3 illustrates a cross-sectional view of first gripper ridge 24. Each of the other illustrated gripper ridges 26, 30, and 32 are constructed similarly to first gripper ridge 24. Gripper ridge 24 includes a first wall 40 normal to the bag wall 28. First wall 40 includes a base end 42 integral with first bag wall 28, and an extended end 44, or free end, at an end opposite to base end 42. Gripper ridge 24 includes a second wall 46 normal to first bag wall 28. Second wall 46 includes a base end 48 and an extended end 50, or free end. Base end 48 is integral with bag wall 28. An end surface 52 extends between extended end 44 of first wall 40 and extended end 50 of second wall 46.

End surface 52 and first extended end 44 are constructed and arranged relative to one another to provide enhanced gripping friction perceptible to touch. More specific to the embodiment illustrated in FIG. 3, end surface 52 and first extended end 44 are arranged to form a gripping end 54 to help the user grasp the bag and manipulate the closure arrangement. The illustrated gripping end 54 represents both sharp points, as well as rounded surfaces. In the embodiment illustrated in FIG. 3, the point is a rounded surface which is made by a die profile having a radius of about 0.009 inch. In other embodiments, the rounded surface of the die profile has a radius of anywhere from about 0.005 to about 0.10 inch. It is advantageous to arrange the gripper ridge such that the gripping end 54 is oriented closer to the closure arrangement than to the top of the bag. In this manner, the shape of the gripper ridge points the user toward the closure arrangement.

First wall 40 has a length which is greater than second wall 46. First wall 40 is arranged relative to bag wall 28 to be closer to zipper 22 than second wall 46 is to zipper 22. This results in end surface 52 being angled toward the closure arrangement 20 in a way such that the user's fingers are directed downward towards the closure arrangement 20. Gripping friction is enhanced when the user applies force away from the closure arrangement 20.

Figure 4:
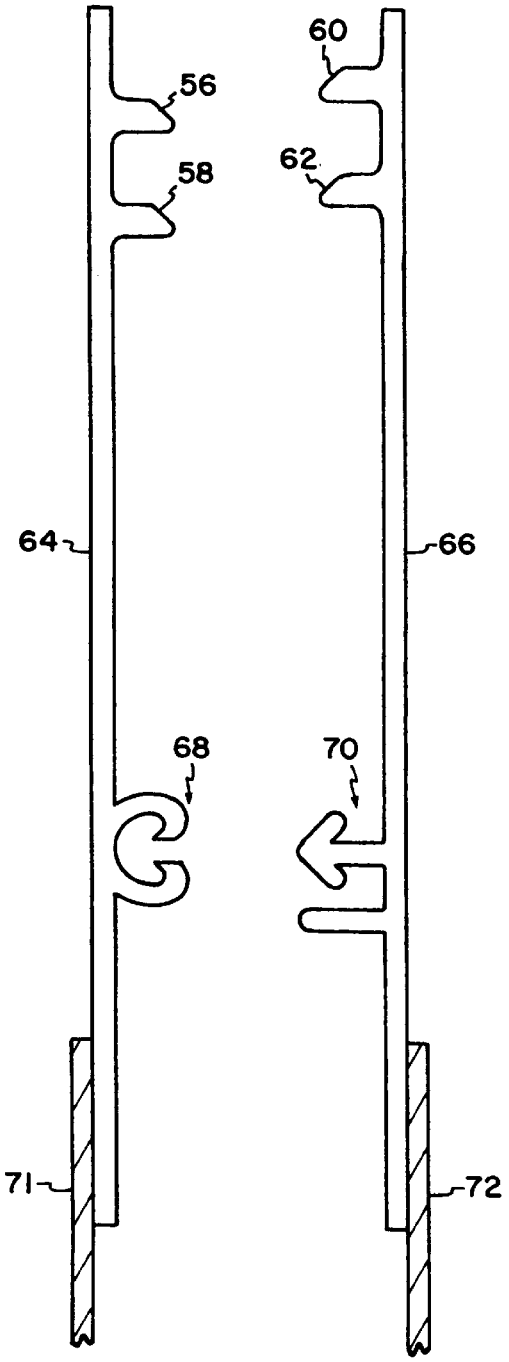
FIG. 4 is a cross-sectional view of a second embodiment of a closure arrangement, constructed in accordance with an embodiment of the claimed invention.

FIG. 4 illustrates a second embodiment of a closure arrangement including gripper ridges and an exemplary reclosable zipper. Other types of reclosable closures are also usable with the gripper ridges of FIG. 4. In this particular illustrated embodiment, first, second, third, and fourth gripper ridges 56, 58, 60, 62 are extruded as part of first and second strips 64, 66. First strip 64 is extruded to include first and second gripper ridges 56, 58 as well as female profile 68 of a zipper-type closure arrangement. Second strip 66 is extruded to include third gripper ridge 60, fourth gripper ridge 62, and male profile 70 of a zipper-type closure arrangement. First and second strips 64, 66 are secured to a pair of bag walls 71, 72, by suitable methods such as heat sealing or by an adhesive, for example. While four gripper ridges are illustrated in the FIG. 4 embodiment, other embodiments include more gripper ridges, while other embodiments include fewer gripper ridges.

Figure 5:
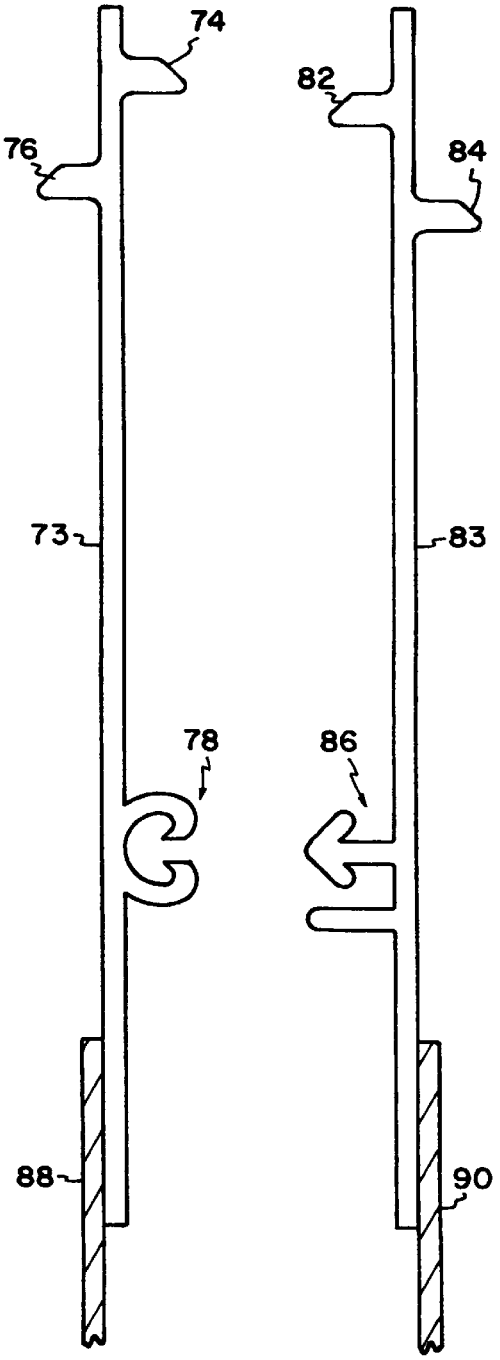
FIG. 5 is a cross-sectional view of a third embodiment of a closure arrangement, constructed in accordance with an embodiment of the claimed invention.

A third embodiment of a closure arrangement is illustrated in FIG. 5. In this illustrated embodiment, a first strip 73 includes first and second gripper ridges 74, 76, and an exemplary female closure profile 78. A second strip 83 includes a third gripper ridge 82, a fourth gripper ridge 84, and an exemplary male profile 86 for a zipper closure. First strip 73 is secured to a first bag wall 88 by a suitable method, such as heat sealing, or by an appropriate adhesive. Similarly, second strip 83 is secured to second bag wall 90 in a similar fashion. In the FIG. 5 embodiment, second gripper ridge 76 and fourth gripper ridge 84 are oriented on the exterior of first and second strips 73, 83, while first and third gripper ridges 74, 82 are oriented on the interior of first and second strips 73, 83. This provides the user with a structure to grip on the bag exterior, as well as the bag interior. Other embodiments include more or fewer gripper ridges.

Figure 6:
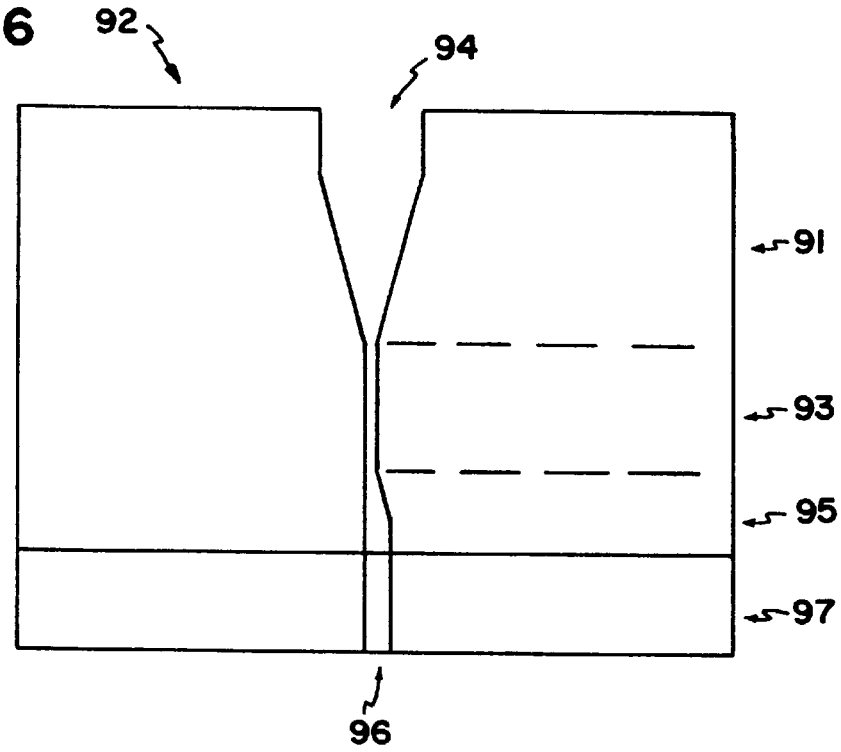
FIG. 6 is a cross-sectional view of an embodiment of a die, constructed in accordance with an embodiment of the claimed invention.
Figure 7:
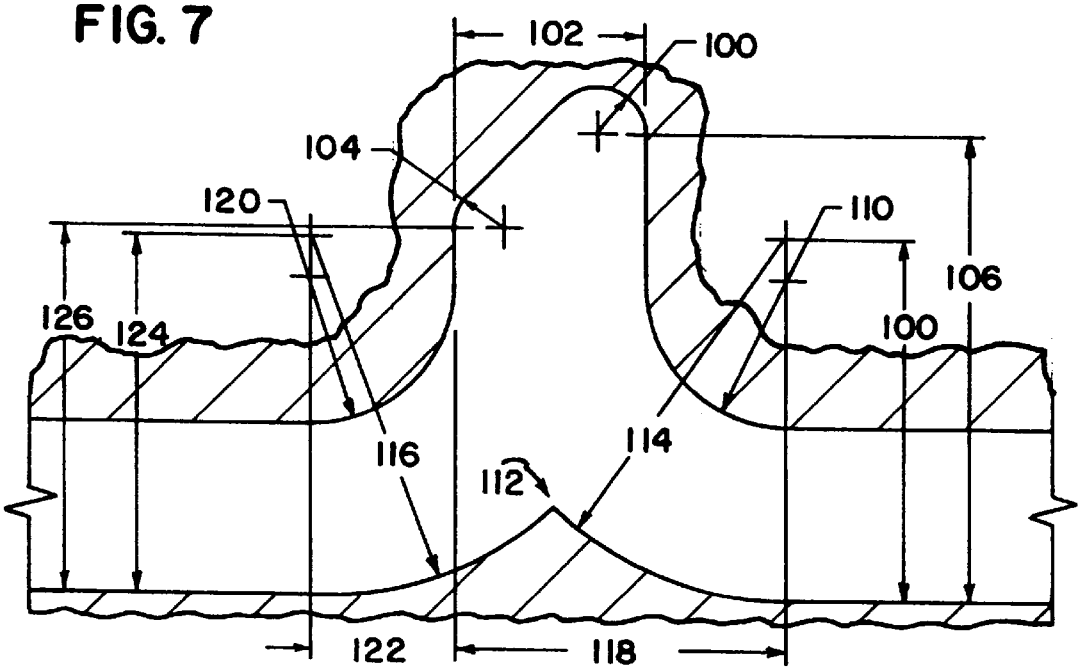
FIG. 7 is a plan view of a die profile of the die plate of FIG. 6, constructed in accordance with an embodiment of the claimed invention.

One embodiment of a die for making a gripper ridge is illustrated in FIGS. 6 and 7. In FIG. 6, a die 92 includes a rounded inlet 94, and a slot-shaped outlet 96. Molten thermoplastic material is pushed through the inlet 94 and extruded through the outlet 96. The polymer melt is transitioned from the rounded inlet 94 to the slot-shaped outlet 96 through a transition area 91 just below inlet 94. Transition area 91 is followed by a land region 93. Land region 93 maintains back-pressure and distributes flow throughout the outlet 96. Land region 93 is followed by relief area 95, which provides polymer melt to the die plate 97, having a profile as illustrated in FIG. 7.

FIG. 7 details a specific implementation of the die plate profile 98. A radius 100 which forms point 54 is about 0.009 inch. In other embodiments, the radius 100 is about 0.005 to 0.10 inch. A width 102 across what forms end surface 52 is about 0.035 inch. A radius 104 at the intersection of what forms end surface 52 and what forms second wall 46 is about 0.009 inch. A height 106 up to a center of radius of what forms gripping end 54 is about 0.085 inch. A height 108 of the center of radius 104 is about 0.066 inch. A radius 110 of the intersection between what forms first wall 40 and what forms the bag wall is about 0.026 inch. Die profile 98 includes a peak 112 at its base portion. Peak 112 helps to maintain a flat surface at its base portion. This peak helps to further reduce the amount of material in the gripper ridge. Furthermore, without peak 112, there would be a bulge of material on the exterior of the gripper ridge. Peak portion 112 includes radii 114, 116 on opposite sides of peak 112. Radii 114, 116 are on a radius of about 0.066 inch. A distance 118 between center of radius 110 and what forms second wall 46 is about 0.062 inch. A radius 120 between what forms second wall 46 and what forms a bag wall is about 0.026 inch. A distance 122 between a center of radius 120 and what forms second wall 46 is about 0.026 inch. A distance 124 between a center of radius 116 and the bottom of die profile 98 is about 0.066 inch. A distance 126 between a center of radius 104 and the bottom of die profile 98 is about 0.067 inch.

A die profile with dimensions as described herein and illustrated in FIG. 7 results in a gripper ridge with a minimal amount of material, while still enhancing the gripper friction and tactile sensation of the user. The dimensions of the extruded profile are considerably less than the dimensions of the die plate profile. In other embodiments, other dimensions of the die profile are used.

To achieve the minimal amount of material and advantageous gripper ridge shape, certain dimension-based ratios are sometimes advantageous. For example, the length of what forms first wall 40 is about 1.5 to 2.5 times the thickness of the base of the gripper ridge. The length of what forms second wall 46 is about 1 to 2 times the thickness of the base. The length of what forms end surface 52 is about 1 to 1.5 times the thickness of the base.

One illustrative way of making a gripper ridge involves a die of a specific profile. An example of one useful profile includes a base, a first edge, a second edge, and a third edge extending between the first and second edges. The first edge extends normal to the base and has a first length, while the second edge extends normal to the base and has a second length less than the first length. One useful die profile is, for example, that as illustrated in FIG. 7. A molten thermoplastic material is pumped through the die inlet, and extruded through the die profile. As it is extruded through, it has a shape as illustrated, for example, in FIG. 3. In one embodiment, the gripper ridge and reclosable zipper profile are extruded together with a wall of a bag. After the extrusion steps, the extrusions are cooled, and then formed into a bag. One way of accomplishing this is by heat sealing together the bag walls, and then cutting them apart into individual bags.

In another embodiment, the gripper ridge and reclosable closure profile are extruded together with a strip. Next, the strip is secured to a sheet of polymeric material by, for example, heat sealing. The panel sections of the bag are then secured together by, for example, heat sealing.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A reclosable package comprising:

(a) an outer enclosure including a surrounding wall portion, a product-supporting bottom, and a reclosable mouth opposing the product-supporting bottom; the wall portion including an interior surface oriented toward an interior of the package and an opposite exterior surface;

(b) a closure arrangement secured to the wall portion and adjacent to the mouth to allow selective opening and closing of the mouth; and (c) a first gripper ridge secured to the interior surface of the wall portion, the first gripper ridge including:

(i) first and second opposite walls; each of said first and second walls being oriented normal to the interior surface of the wall portion;

(A) the first wall including a first extended end and having a first length;

(B) the second wall including a second extended end and having a second length; the first length being greater than the second length; the first wall being closer to the closure arrangement than the second wall; and (ii) an end surface extending between the first and second extended ends;

(A) the end surface arranged and configured to form a first gripping end perceptible to touch as oriented toward the closure arrangement.

2. A reclosable package according to claim 1, wherein the first gripping end includes a rounded surface.

3. A reclosable package according to claim 1, wherein the closure arrangement includes a zipper-type closure.

4. A reclosable package according to claim 1, wherein the surrounding wall includes first and second opposed panel sections joined along a pair of sealed edges, each of the first and second panel sections including an interior surface and an exterior surface.

5. A reclosable package according to claim 4, wherein the first gripper ridge is secured to at least one of the interior surface and the exterior surface of the first panel section and is located between the mouth and the closure arrangement.

6. A reclosable package according to claim 5, wherein the package further includes a plurality of gripper ridges secured to at least one of the interior surface of the second panel section, the exterior surface of the second panel section, and the exterior surface of the first panel section.

7. A reclosable package according to claim 6, wherein the plurality of gripper ridges include a gripping end perceptible to touch as oriented toward the zipper closure arrangement.

8. A reclosable package according to claim 1, further including a first strip arranged to secure the first gripper ridge and the closure arrangement to the wall portion.

9. A reclosable package according to claim 8, further including a plurality of gripper ridges secured to the first strip.

10. A reclosable package according to claim 9, wherein the plurality of gripper ridges are secured to at least one of an exterior surface of the first strip and an interior surface of the first strip.

11. A reclosable package according to claim 1, further including:

(a) a first strip arranged to secure the first gripper ridge to the first panel section;

(b) a second strip; and (c) a second gripper ridge, the second strip arranged to secure the second gripper ridge to the second panel section.

12. A reclosable package according to claim 11, further including:

(a) a third gripper ridge secured to the first strip; and (b) a fourth gripper ridge secured to the second strip.

* * * * *